US008544302B2

(12) United States Patent
Goldman

(10) Patent No.: US 8,544,302 B2
(45) Date of Patent: Oct. 1, 2013

(54) DOOR CYLINDER LOCK

(75) Inventor: Ilan Goldman, Herzliya (IL)

(73) Assignee: Knock N'Lock Ltd., Yokneam (IL)

( * ) Notice: Subject to any disclaimer, the term of this patent is extended or adjusted under 35 U.S.C. 154(b) by 0 days.

(21) Appl. No.: 13/515,392

(22) PCT Filed: Jan. 25, 2011

(86) PCT No.: PCT/IL2011/000085
§ 371 (c)(1),
(2), (4) Date: Jun. 12, 2012

(87) PCT Pub. No.: WO2011/089612
PCT Pub. Date: Jul. 28, 2011

(65) Prior Publication Data

US 2012/0324969 A1 Dec. 27, 2012

Related U.S. Application Data

(60) Provisional application No. 61/297,941, filed on Jan. 25, 2010.

(51) Int. Cl.
*E05B 47/00* (2006.01)

(52) U.S. Cl.
USPC ..... 70/277; 70/276; 70/208; 70/278.7; 70/223; 70/472

(58) Field of Classification Search
USPC ..... 70/276, 277, 278.1–278.3, 278.7, 70/279.1, 283, 283.1, 472, 218, 222–224
See application file for complete search history.

(56) References Cited

U.S. PATENT DOCUMENTS

| | | | | |
|---|---|---|---|---|
| 3,438,227 | A * | 4/1969 | Wolniak | 70/208 |
| 4,167,104 | A * | 9/1979 | Bond | 70/208 |
| 5,771,722 | A * | 6/1998 | DiVito et al. | 70/277 |
| 6,113,160 | A | 9/2000 | Johansson et al. | |
| 6,158,259 | A * | 12/2000 | Schmitz et al. | 70/276 |
| 6,264,256 | B1 * | 7/2001 | Hankel et al. | 292/336.3 |
| 6,865,916 | B2 | 3/2005 | Goldman | |
| 7,007,526 | B2 * | 3/2006 | Frolov et al. | 70/277 |

(Continued)

FOREIGN PATENT DOCUMENTS

| | | | |
|---|---|---|---|
| GB | 2211239 | A * | 6/1989 |
| GB | 2305965 | A * | 4/1997 |
| WO | 0069181 | A1 | 11/2000 |
| WO | 03064794 | A1 | 8/2003 |

OTHER PUBLICATIONS

International Search Report published Jul. 28, 2011 for PCT/IL2011/000085, filed Jan. 25, 2011.

(Continued)

*Primary Examiner* — Suzanne Barrett
(74) *Attorney, Agent, or Firm* — Fleit Gibbons Gutman Bongini & Bianco PL; Martin Fleit; Paul D. Bianco

(57) ABSTRACT

The presently disclosed subject matter is directed towards an anti-vandalism electronic cylinder lock (10). The lock comprising a cylinder housing (30), an electronic cylinder lock mechanism, an inside knob (26), and an outside knob (100), the outside knob (100) being configured for assuming a first non-accessible, non-operable, retracted position, and a second, accessible operative position, in which the outside knob (100) projects from the cylinder housing (30).

9 Claims, 6 Drawing Sheets

(56) References Cited

U.S. PATENT DOCUMENTS

| | | | | |
|---|---|---|---|---|
| 2002/0095964 | A1* | 7/2002 | Davis | 70/278.3 |
| 2004/0040355 | A1 | 3/2004 | Goldman | |
| 2009/0308117 | A1* | 12/2009 | Goldman | 70/277 |
| 2011/0083482 | A1 | 4/2011 | Goldman | |

OTHER PUBLICATIONS

International Preliminary Report on Patentability published on Jul. 31, 2012 for PCT/IL2011/000085, filed Jan. 25, 2011.

Written Opinion published on Jul. 25, 2012 for PCT/IL2011/000085, filed Jan. 25, 2011.

* cited by examiner

DOOR CYLINDER LOCK

FIELD OF THE INVENTION

This invention relates to door cylinder locks and more particularly to electronic door locks which are substantially vandal-resistant.

BACKGROUND OF THE INVENTION

A cylindrical lock for a door conventionally includes a spring-loaded retractor for retracting and releasing a latchbolt for unlatching and latching the door. The lock housing is mounted in a bore extending through the door. The lock is operated by rotating either one of an inside knob and an outside knob, with the outside knob generally equipped with a key-actuable lock for preventing unlocking of the lock, e.g. by rotating an outside knob and/or the handle associated with the lock. Cylindrical locks are typically considered to be economical in terms of their manufacture and installation, however they are vulnerable to damage by vandals and burglars such as through destructive manipulation of the cylindrical lock's outside knob. Such manipulation might cause damage to the mechanism linking the lock to the knob and might prevent opening of the lock and thus subsequent unlatching of the door.

WO 2004/020767 discloses one type of an electromechanical cylinder lock for use in a door lock, comprising an outer plug, an inner plug, a rotary cam adapted to move a deadbolt of the door lock, and a clutch adapted to engage for rotation the outer plug to the rotary cam. The cylinder lock further comprises an electronic blocking device (EBD) and a drive adapted to actuate the clutch upon an unblocking command from the EBD generated upon receiving therein an unblocking signal emitted from the outer side of the door, thereby enabling moving the deadbolt by rotation of the outer plug. The cylinder lock comprises an inner handle/knob attached thereto at the inner side of the door, the EBD and the drive being entirely accommodated within the inner handle/knob. The signal is emitted by an electronic key or panel and may be a mechanical vibration signal, a light signal, or a radio signal.

SUMMARY OF THE INVENTION

The presently disclosed subject matter is directed to an anti-vandalism electronic cylinder lock comprising a cylinder housing, an electronic cylinder lock mechanism, an inside knob, and an outside knob. In accordance with the presently disclosed subject matter, the outside knob is configured for assuming a first non-accessible, substantially non-operable, retracted position, and a second, accessible, operative position in which the outside knob is configured to project from the cylinder housing and is accessible from the outside.

In accordance with an embodiment of the presently disclosed subject matter, the electronic cylinder lock is actuatable by a solenoid which may be configured for being fitted within the inside knob.

In accordance with yet an embodiment, the knob may be slideably though restrictedly received within a knob cavity provided in the cylinder housing. In accordance with yet an embodiment, in the operative position the outside knob may project from the cylinder and may thus be accessible.

In accordance with an embodiment of the presently disclosed subject matter, following activation of the electronic lock, the knob may be configured to assume the operative position which is achievable upon inward axial displacement of the outside knob. In accordance with this embodiment, following the axial displacement of the knob, said knob is pushed outward the cylinder housing.

The presently disclosed subject matter is directed to an anti-vandalism electronic cylinder lock wherein an outside knob is configured between a substantially non-operable, retracted, non-accessible position, and an operative position wherein the outside knob projects from the door and is accessible. According to an embodiment of the presently disclosed subject matter, in the non operable procedure the knob is received within the cylinder housing.

The presently disclosed subject matter discloses a cylinder lock for use with a door lock configured for mounting in a door defining an inside and an outside, the lock comprises a housing accommodating an inside plug, an outside plug and a rotary cam for manipulating a deadbolt of the door lock.

The inside plug is articulated to an inside knob fitted with a solenoid operable by an electric mechanism, and the outside plug is articulated with an outside knob, said outside knob displaceable between a closed position in which it is retracted and substantially flush with an outside surface of the door, and an open position in which it projects from the outside surface of the door and is engaged with the cam.

In accordance with an embodiment of the presently disclosed subject matter, an outside knob forms part of the cylinder lock housing.

In accordance with another aspect of the presently disclosed subject matter a method of unlocking an anti-vandalism electronic cylinder lock is provided. The method comprises:

(a) Providing an electronic cylinder lock mechanism mounted within a cylinder housing fitted within a door, the electronic cylinder lock comprising an electronic cylinder lock mechanism, an inside knob, and an outside knob, the outside knob being configured for assuming a first non-accessible, non-operable, retracted position, and a second, accessible operative position, in which the outside knob projects from the cylinder housing;

(b) Actuating the locking mechanism to unlock the cylinder lock;

(c) Applying axial pressure on the knob, configured to achieve inward, axial displacement of the outside knob resulting in an outward axial displacement of the knob to at least partially project from the cylinder; and (d) Rotating the outwardly projecting knob to unlatch the lock.

A method in accordance with an embodiment of the presently disclosed subject matter, wherein applying inward axial pressure on the outwardly projecting knob will urge the knob into its initial, retracted position.

In accordance with yet an aspect of the presently disclosed subject matter, there is provided a door fitted with a door lock comprising an electronic cylinder lock comprising a cylinder housing, an electronic cylinder lock mechanism, an inside knob, and an outside knob, wherein the outside knob is configured for assuming a first non-accessible, substantially non-operable, retracted position, and a second, accessible, operative position in which the outside knob is configured to project from the cylinder housing and is accessible from the outside.

BRIEF DESCRIPTION OF THE DRAWINGS

In order to understand the invention and to see how it may be carried out in practice, embodiments will now be described, by way of a non-limiting example only, with reference to the accompanying drawings, in which.

DETAILED DESCRIPTION OF EMBODIMENTS

Figures 1A, 1B:
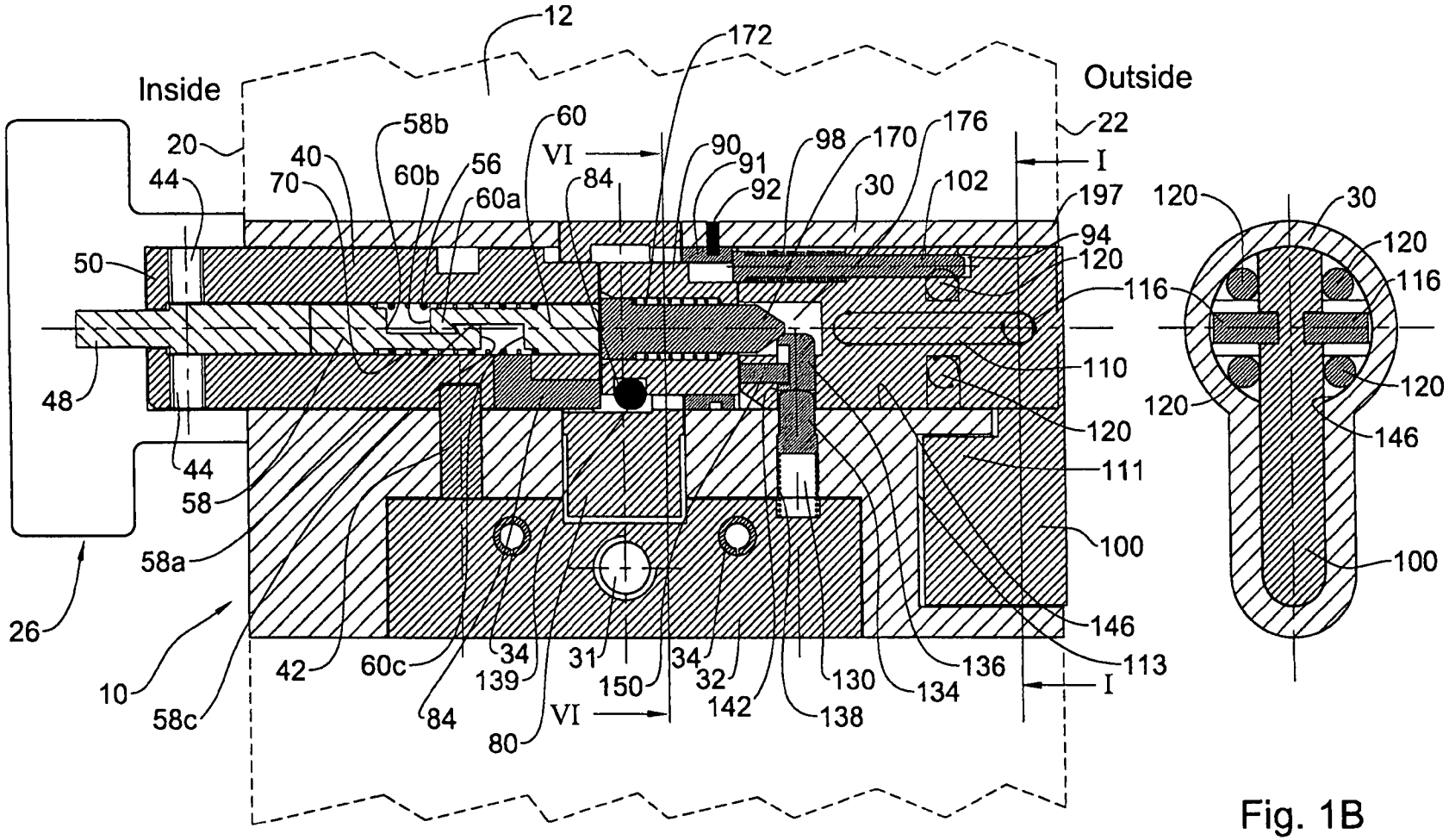
FIG. 1A is a longitudinal section of a cylinder lock according to the disclosed subject matter, at an initial, closed position, with the outside knob fully retracted.
FIG. 1B is a section taken along line I-I in FIG. 1A.

One example of an electronic cylinder lock in accordance with presently disclosed subject matter will now be described. Attention is directed to FIGS. 1A to 8B for familiarizing with the components of the cylinder lock subject of the presently disclosed subject matter. The lock, generally designated 10 is mounted in a door-lock (not illustrated) fitted in a door schematically represented by dashed lines, designated 12, defining an inside face 20 and an outside face 22.

The cylinder lock 10 is of the type articulated to an electronic knob/lock assembly generally designated 26, e.g. of the type disclosed in detail in WO 2004/020767 however fitted with a solenoid for activating the cylinder lock 10 as will be discussed hereinafter in further detail.

The cylinder lock 10 comprises a housing 30 of common shape and size for snuggly and fitting and arresting within a door lock, as known per se. The size of the housing is such that it extends within the door 12 and substantially does not project therefrom. The housing 30 is reinforced by an anti-snap plate 32, secured to the housing 30 by pins 34 extending therethrough. Housing 30 is formed with a threaded aperture 31 for fixedly securing within the door lock.

An inside plug 40 is retained in the housing 30 by means of retaining pin 42, the inside plug 40 projecting from the housing 30 towards the inside end thereof to facilitate attachment of the knob 26 thereto, by use of suitable pins or screws inserted into bores 44.

Slidingly received within the inside plug 40 there is a push-pin 48 projecting from the fore face 50 of the inside plug, said push-pin being articulated with the locking assembly of the knob 26 and manipulable by an electronic solenoid received therein.

Push-pin 48 constitutes part of a buffer arrangement designed at 56 and comprising a right buffer grip 58 and a left buffer grip 60, both fitted at their adjoining ends with an engaging projection 58*a* and 60*a*, respectively whereby the buffer grips are axially displaceable within the inside plug 40 only by a limited extent defined between facing walls 58*b* and 60*b*, and 58*c* and 60*c*, respectively. The buffer 56 is spring loaded whereby the left buffer grip 58 and the right buffer grip 60 are urged away from one another into the position illustrated in FIG. 1A (which however is a non-compressed position of the coiled spring 70).

The buffer 56 serves for buffering forward motion of the push-pin 48 upon activation by a solenoid of the knob 26.

A cam 80 is mounted in the housing 30 and is rotatably retained over the inside plug 40 and over a respective portion of an outside plug as will be discussed hereinafter. However, rotation of the inside plug 40 entails corresponding rotation of the cam 80 to thereby activate the door lock (not shown) between locked and unlocked positions of a dead bolt thereof. Engagement of the cam 80 with the inside plug 40 ensures that rotation of the knob 26 entails corresponding rotation of cam 80 thereby locking/unlocking the door lock, regardless of the situation of the electronic locking mechanism.

An arresting steel ball 84 is received within a bore 139 (also seen in FIG. 6A) of the outside plug 90 and is fitted for engagement within one of three radial grooves 141 formed in the cam 80, for rotary engagement thereof.

Figure 3:
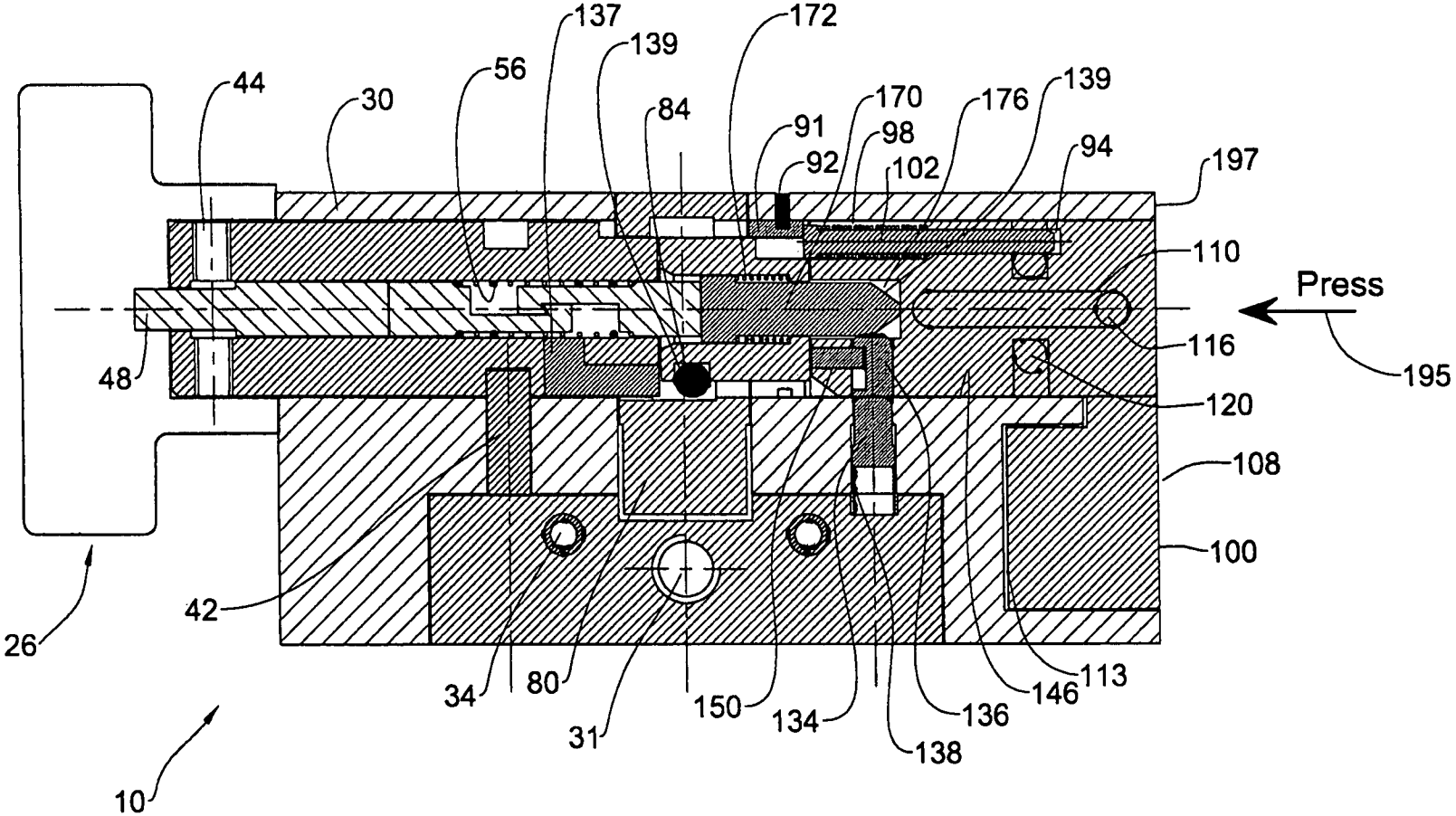
FIG. 3 is a longitudinal section of the cylinder lock at a consequent opening step.
Figure 4:
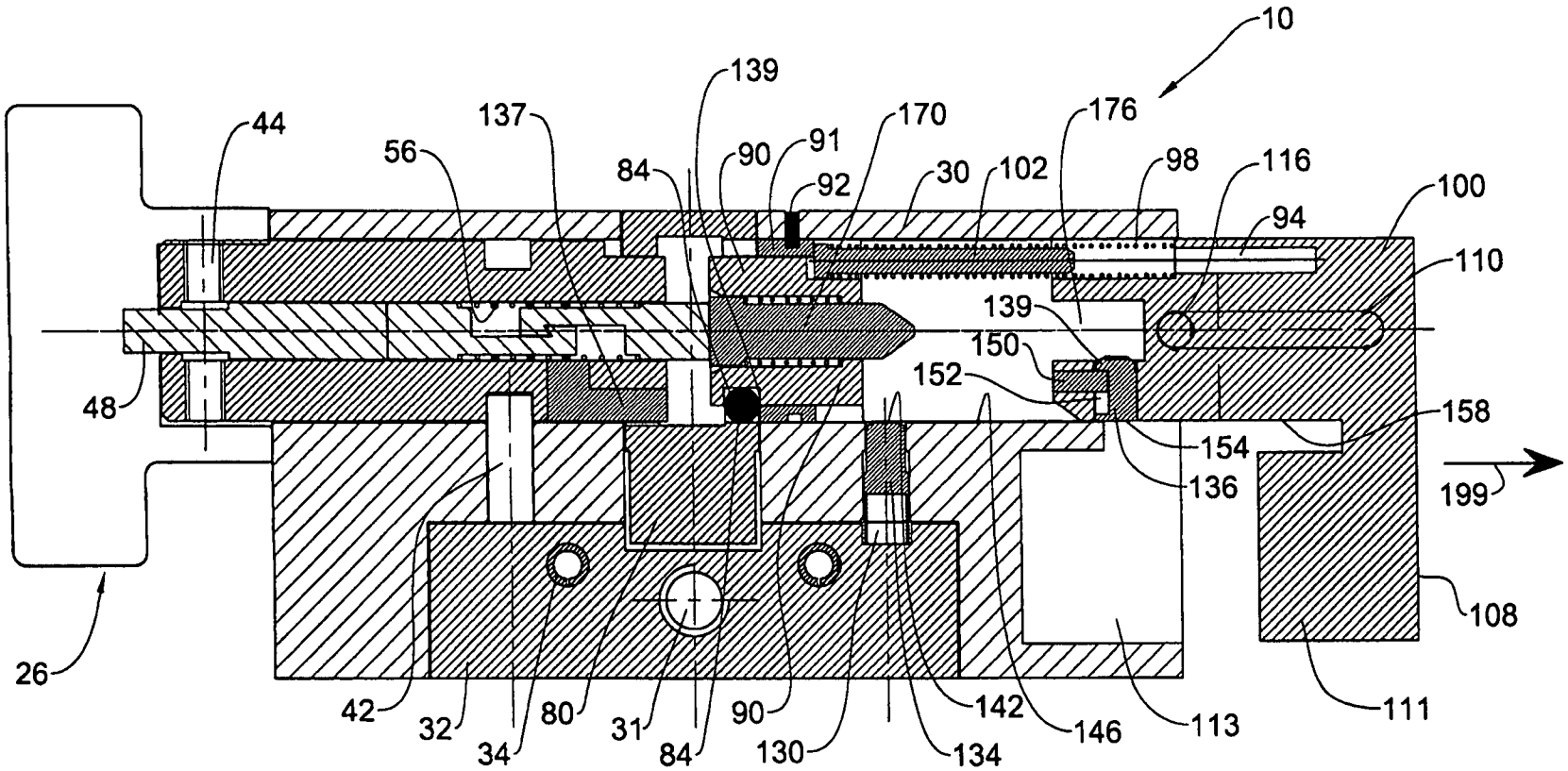
FIG. 4 is a longitudinal section of the cylinder lock with the outside knob fully projecting.

Turning now to the right side of the cylinder lock 12 there is illustrated an outside plug 90 rotatably received within the housing 30 and configured with a central cavity receiving an outside knob 100 which as will be discussed hereinafter in further detail is slideably though restrictedly received within said cavity between a fully retracted position (FIGS. 1A, 2 and 3) and a projecting position (FIG. 4).

Figure 2:
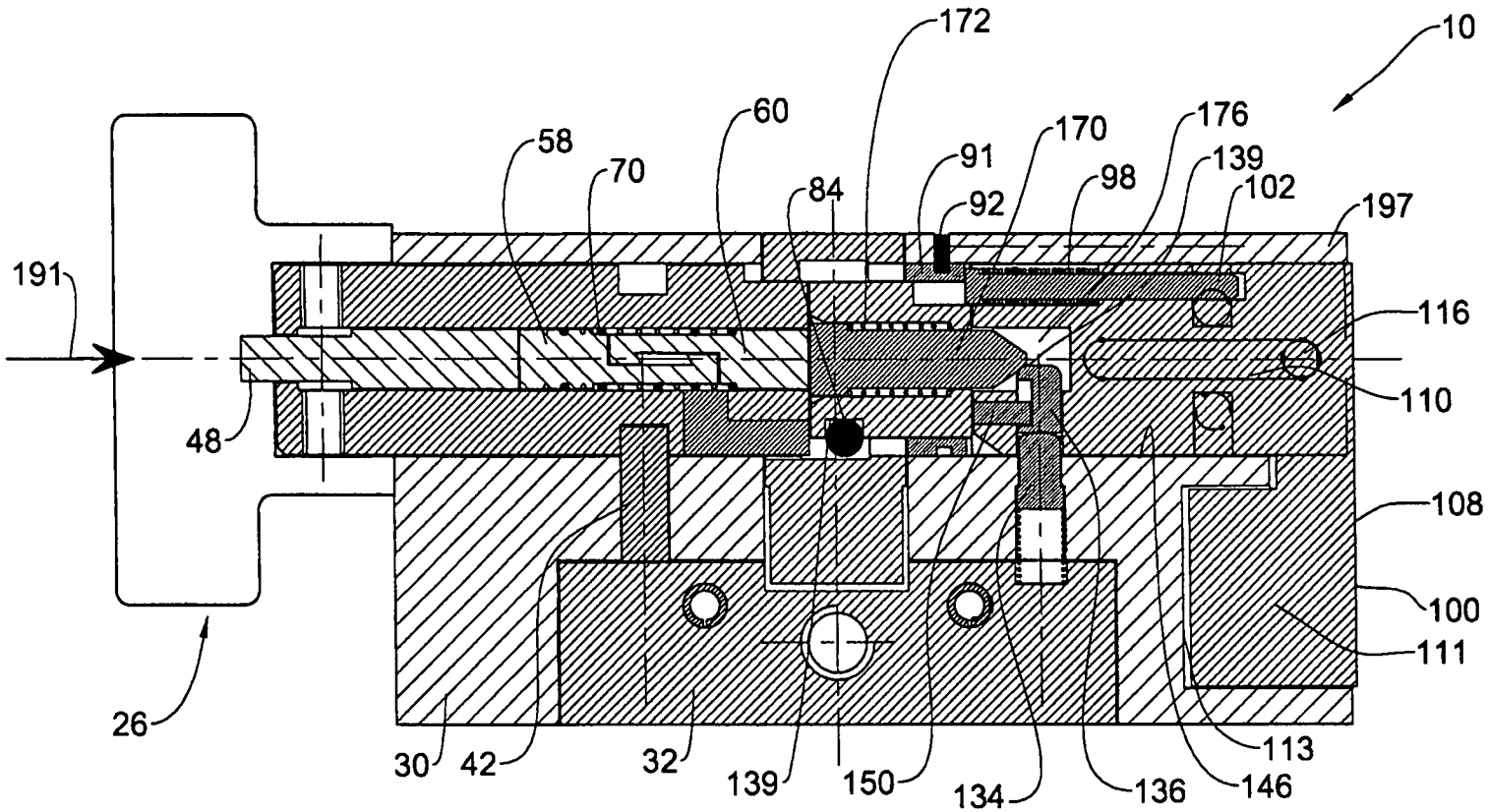
FIG. 2 is a longitudinal section of the cylinder lock at a first opening step.

The outside plug 90 is secured within the housing 30 by a retaining ring 91 fixed within the housing by a spring ring 92 facilitating both fixating the outside plug 90 within housing 30 and further to secure in place a pushing rod 102 spring loaded within a groove 94 extending within the knob 100, by means of a coiled compression spring 98. Coiled spring 98 is a substantially strong spring i.e. being the strongest spring within the cylinder lock assembly 10, the purpose of which will be discussed hereinafter. In FIGS. 1A, 2 and 3 the spring exerts maximum force.

Figure 1C:
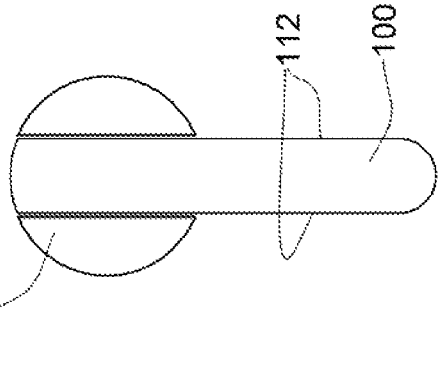
FIG. 1C is a section along line I-I illustrating only the cam and outside knob.
Figure 8B:
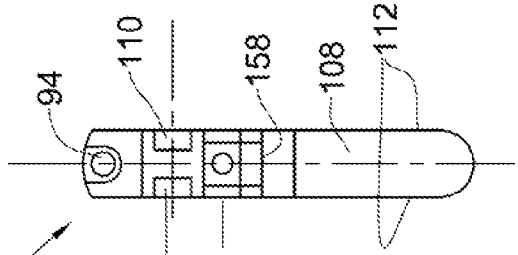
FIG. 8B is a view of the outside knob taken from direction of arrow B in FIG. 8A.
Figure 8A:
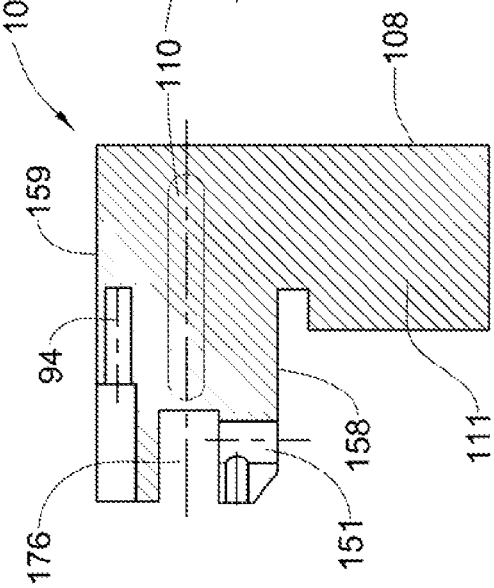
FIG. 8A section of the outside knob.

Knob 100 is a substantially flat element (though other configurations are envisioned as well) formed with an outside flat face 108 which at the locked, retracted position of the cylinder lock as in FIGS. 1-3 is substantially flush with the outside door surface 22 though may project about 1 mm or so as noted in the drawings, for the purpose to become apparent hereinafter. A longitudinal recess 110 (also seen in FIG. 8B) is formed on each of the side faces 112 of knob 100, each of said recesses 110 being slidingly engaged over a restricting pin 116 laterally projecting from the outside plug 90, such that the knob 100 is slideably displaceable with respect to the outside plug between its respective retracted position and fully projecting position, respectively.

In the disclosed example the outside knob 100 is configured with a downward extending projection 11, necessitating a corresponding cavity 113 in the housing (cavity 113*t* seen in FIG. 4). However, it is appreciated that the outside knob may assume different shapes as well, without departing from the scope of the disclosed subject matter.

Four tempered ball bearings 120 are provided within the outside plug 90 which together with pins 116 which are two tempered provide anti-drilling/anti-tempering barriers.

Formed within the housing 30 there is a radial bore 130 accommodating a two-stage pin assembly composed of a lower pin 134 and an upper pin 136 urged upwardly by a coiled compression spring 138. The arrangement is such that the lower pin 134 is displaceable between a projecting position (FIGS. 1A and 2) and a retracted position (FIG. 3) wherein at the retracted position an upper face 142 of the lower pin 134 is substantially flush with the surface 146 of the central cavity of the housing 30.

The upper pin 136 is retained within the outside knob by a retention pin 150 projecting into a recess 152 of the upper pin 136, whereby pin 136 is restrictedly displaceable between an upward projecting position (FIG. 2) and a downward position (FIG. 4) wherein a bottom surface thereof 154 extends substantially flush with a bottom surface 158 of the outside knob 100.

Further noted, the cylinder lock 10 is fitted with a central conical pin 170 axially displaceable within the outside plug 90, said pin 170 being spring loaded by a coiled compression spring 172, whereby the pin is displaceable between a retracted position (FIGS. 1A and 2) though it is appreciated that in this position it projects into the cavity 176 within the outside knob 100, and a fully projecting position (FIGS. 3 and 5) against the biasing effect of coiled spring 172. The forehead of spring 170 is conical and at the retracted position (FIGS. 1A and 2) the conical portion bears against a corresponding chamfered portion 139 of the upper pin 136.

It is noted that the groove 94 receiving the pushing rod 102 extends above the center line of the outside knob 100 and owing to the strong coiled spring 98 there exists a significant force attempting to exert the knob into its projecting position (FIG. 4) however owing to tolerances between the surface 146 of the central cavity of housing 30 and the bottom surface 158 and top surface 159 of the outside knob 100, the knob will not spontaneously displace into the projecting position of FIG. 4, but only upon releasing clamping engagements within the cylinder lock, as will be discussed hereinafter.

Reverting now to FIG. 1A the cylinder lock 10 is illustrated in its locked position wherein push-pin 48 is at its retracted position (projects into the knob 26) resulting in expansion of the buffer 56 i.e. the coiled spring 70 is at its substantially non-compressed state. Further in this position, the central pin 170 is at its retracted position though its fore tip projects forwards into cavity 176, however with the compression spring 172 at its substantially non-compressed position. Further noted, the two-stage pin assembly, namely lower pin 134 and upper pin 136 are at their upward position such that the lower pin 134 is received within aperture 151 of knob 100 thus arresting it and preventing its outward retraction. Likewise, the upper pin 136 projects upwards into the cavity 176 wherein both the lower pin 134 and upper pin 136 are supported by the coiled spring 138, at its substantially non-compressed position as illustrated in FIG. 1A.

At this position the pushing rod 102 is almost fully received within the groove 94 of knob 100 with the compression spring 98 at its substantially fully compressed position, now also exerting a clamping force owing to slight tilt of knob 100 within the central opening of the housing 30.

In this, locked position, the cam 80 may be manipulated to engage the dead bolt of the door lock by the knob 26, whereby rotations of will entail corresponding rotation of cam 80 to open/lock the deadbolt of the door lock. Further noted, the outside knob 100 is substantially flush with the outside surface 22 of the door, though slightly projecting therefrom, to an extent of about 1 mm. It is appreciated that the design may be such that rather than projecting from the outside surface 22 the surface 108 of the outside knob 100 may be completely flush with the outside surface 22 of the door 12 or the outer surface 97 of the housing 30. At the position of FIG. 1A, the outside knob 100 is arrested within the housing 30 and cannot be rotated or pulled/pushed owing to projection of the two-stage pins 134 and 136.

Turning now to FIG. 2, the cylinder lock 10 is illustrated at a first stage of opening, namely after activating of the electronic lock 26 resulting in propelling of push-pin 48 inwards, namely in direction of arrow 191, resulting in corresponding displacement of the right buffer grip 58 into contracted position against the left buffer grip 60 further resulting in compression of the coiled spring 70.

As seen in FIG. 2, the left buffer grip 60 does not propel responsive to axial displacement of the right buffer grip 58, this owing to central conical pin 170 which yet remains at its non-propelled position such that the coiled spring 172 is still at its substantially non-compressed position. It is appreciated that the central conical pin 170 is arrested by the upper pin 136 which at this stage is prevented from downward displacement owing to clamping arrestment and sheer force existing on the lower pin 134, owing to substantial force exerted by the coiled spring 98 of pushing rod 102.

Within a predetermined period of time, say about 3 to 5 seconds (this span of time being however programmable within the electronic mechanism of knob 26) the user should apply axial force in direction of arrow 195 as illustrated in FIG. 3. Such pressure will result in slight inwards displacement of the outside knob 100, where the outside surface 108 is now substantially flush with the outside surface 197 of the cylinder housing 30. The insignificant axial displacement of the outsideknob 100 in direction of arrow 195 results in release of the clamping arresting of the lower pin 134, resulting in coiled spring 172 exerting axial force on the central conical pin 170 to propel forwards into cavity 176 resulting in downward displacement of the upper pin 136 with corresponding downward displacement of the lower pin 134 against the biasing effect of spring 138 which will now compress.

It is noted that downward displacement of the upper pin 136 is to an extent further forward displacement of the pin 170 however without projecting from the bottom surface 158 of the knob 100 (see also FIG. 4). Likewise, the lower pin 134 is now fully received within the radial bore 130, thus not constituting a bar to forward displacement of the outside plug 90, or knob 100, and thereby release of the instantaneous pressure applied in direction of arrow 195 now results in spontaneous displacement of the outside knob 100 in direction of arrow 199, in the position of FIG. 4 wherein it fully projects from the cylinder housing 30, outwardly biased under compression force of spring 98.

In the position of FIG. 4 the steel ball 84 is received within one of the radial grooves 141 of the cam 80 (FIG. 7) whereby rotating of the outside knob 100 entails corresponding rotation of the cam 80 to thereby activate the deadbolt of the door lock.

At the projecting position of FIG. 4, the outside knob 100 is prevented from excessive displacement (i.e. detaching from the housing 30) owing to engagement of steel ball 84 against the retaining ring 91 securely fixed within the housing 30.

Figure 5:
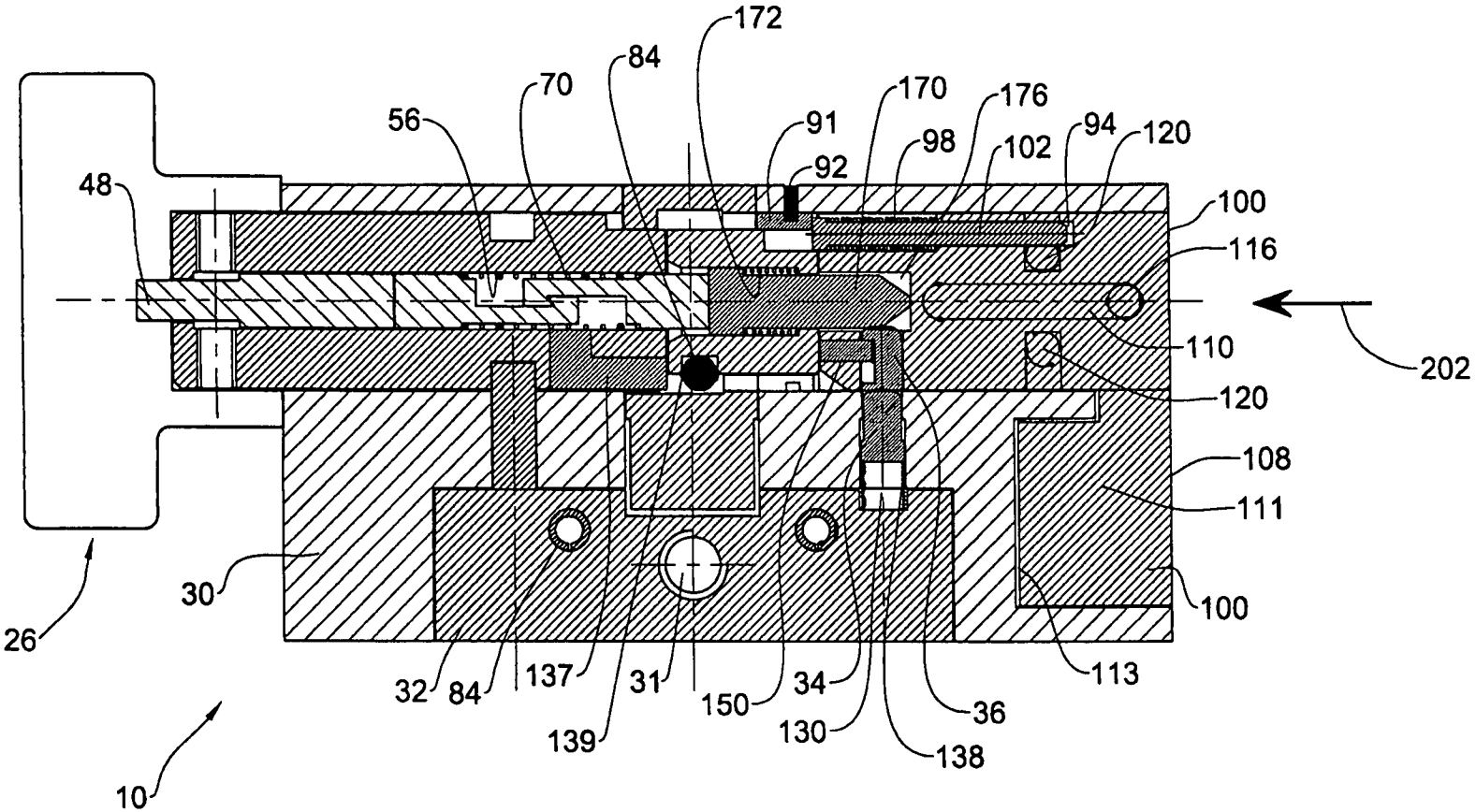
FIG. 5 is a longitudinal section of the cylinder lock at a consequent locking step.
Figure 7:
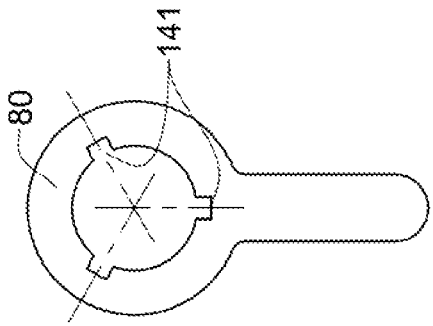
FIG. 7 section of the cam only, taken along line VI-VI in FIG. 1.
Figure 6C:
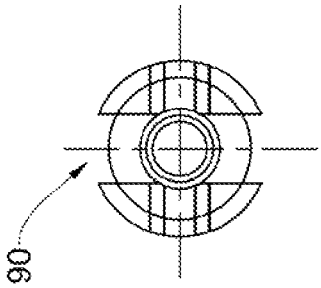
FIGS. 6B and 6C are respective right and left views of the outside plug of FIG. 6A.
Figure 6A:
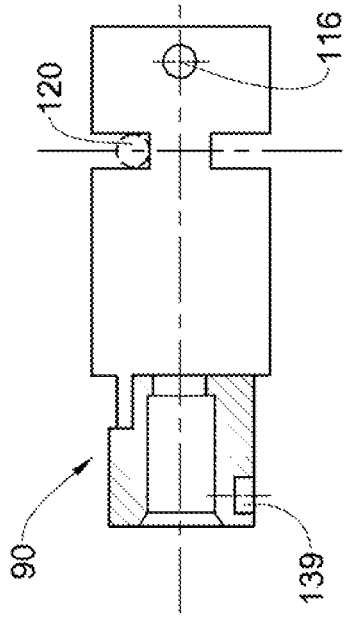
FIG. 6A is a partially sectioned view of an outside plug used in the cylinder lock.
Figure 6B:
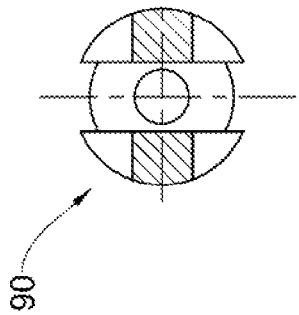

Returning the cylinder lock 10 into its original position of FIG. 1 takes place by applying force on the outside knob 100 in direction of arrow 202 in FIG. 5, resulting in displacing the knob back into its original position whilst during that time, the solenoid of the electronic mechanism of knob 26 may already return to its non-activated position admitting displacement of pushing rod 48 back into its initial position whereby the buffer assembly 56 displaces back into its initial position followed by corresponding displacement of the central conical pin 170 into its retracted position facilitated by coiled spring 70.

Those skilled in the art to which this invention pertains will readily appreciate that numerous changes, variations, and modifications can be made without departing from the scope of the invention, mutatis mutandis.

The invention claimed is:

1. An electronic cylinder lock comprising a cylinder housing accommodating a two-stage pin assembly comprising a lower pin cooperating with an upper pin, a solenoid-operated electronic cylinder lock mechanism, an inside knob fitted with a solenoid therein, and an outside knob having a cavity, the outside knob being configured for assuming a first non-accessible, non-operable, retracted position, in which the outer knob is arrested from movement within the housing by projection of the two-stage pin assembly into the cavity; and a second, accessible operative position in which the outside knob is allowed to project from the cylinder housing following displacement of the two-stage pin assembly induced by the solenoid.

2. The lock in accordance with claim 1, wherein the outside knob is slideably though restrictedly received within a knob cavity provided in the cylinder housing.

3. The lock in accordance with claim 1, wherein in the operative position, the outside knob is engaged with a rotary cam through an outer plug.

4. The lock in accordance with claim 1, wherein in the operative position, the outside knob projects from a door and is accessible.

5. The lock in accordance with claim 1, wherein the outside knob is configured to assume the operative position achievable by inward axial displacement of the outside knob, upon activation of the electronic mechanism.

6. An electronic cylinder lock according to claim 1 for use with a door lock configured for mounting in a door defining an inside and an outside, the lock comprising a housing accommodating an inside plug, an outside plug and a rotary cam for manipulating a deadbolt of the door lock, wherein, the inside plug is articulated to the inside knob of the electronic cylinder lock, and the outside plug is articulated with the outside knob of the electronic cylinder lock, said outside knob displaceable between a closed position in which the outside knob is received within the cylinder housing and substantially flush with an outside surface of the cylinder housing, and an open position in which the outside knob projects from the outside surface of the cylinder housing and is engaged with the rotary cam.

7. A method of unlocking an anti vandalism the electronic cylinder lock of claim 1, the method comprising:

(a) providing an electronic cylinder lock mechanism mounted within a cylinder housing fitted within a door lock, the electronic cylinder lock comprising an electronic cylinder lock mechanism, an inside knob, and an outside knob, the outside knob being configured for assuming a first non-accessible, non-operable, retracted position, and a second, accessible operative position, in which the outside knob projects from the cylinder housing;

(b) actuating the locking mechanism to unlock the cylinder lock;

(c) applying axial pressure on the outside knob, configured to achieve inward, axial displacement of the outside knob resulting in an outward axial displacement of the outside knob to at least partially project from the cylinder; and (d) rotating the outside knob to unlatch the lock.

8. A method in accordance with 7, wherein applying inward axial pressure on the outside knob will urge the outside knob into its initial, retracted position.

9. A door fitted with a door lock comprising the electronic cylinder lock of claim 1.

* * * * *